US005123866A

United States Patent [19]

Endo et al.

[11] Patent Number: 5,123,866

[45] Date of Patent: Jun. 23, 1992

[54] ELECTRICAL CONNECTOR WITH TERMINAL RETAINING MEMBER

[75] Inventors: Takayoshi Endo; Sakai Yagi; Masanori Tsuji; Kimihiro Abe; Satoshi Yamada, all of Shizuoka, Japan

[73] Assignee: Yazaki Corporation, Tokyo, Japan

[21] Appl. No.: 734,972

[22] Filed: Jul. 24, 1991

[30] Foreign Application Priority Data

Aug. 1, 1990 [JP] Japan ..... 2-202462

[51] Int. Cl.[5] ..... H01R 13/514

[52] U.S. Cl. ..... 439/752; 439/595

[58] Field of Search ..... 439/595, 596, 752

[56] References Cited

U.S. PATENT DOCUMENTS

| | | | |
|---|---|---|---|
| 4,867,712 | 9/1989 | Kato | 439/752 |
| 4,921,448 | 5/1990 | Endo et al. | 439/595 |
| 5,037,336 | 8/1991 | Betsui | 439/752 |

FOREIGN PATENT DOCUMENTS

| | | |
|---|---|---|
| 59-119688 | 7/1984 | Japan . |
| 61-4174 | 1/1986 | Japan . |
| 234083 | 3/1990 | Japan . |

*Primary Examiner*—Eugene F. Desmond

*Attorney, Agent, or Firm*—Sughrue, Mion, Zinn, Macpeak & Seas

[57] ABSTRACT

An electrical connector wherein terminals are secured inside terminal receiving chambers by virtue of a retaining member. The retaining member has elongated retaining protrusions that enter the terminal receiving chambers so as to operatively engage with and secure a position of the terminals. The terminal retaining protrusions enter the terminal receiving chambers through holes formed on the sides thereof so as to allow the retaining member to be essentially accommodating within the lengthwise dimension of the connector body.

9 Claims, 3 Drawing Sheets

ELECTRICAL CONNECTOR WITH TERMINAL RETAINING MEMBER

BACKGROUND OF THE INVENTION

1. Field of the Invention

This invention relates to an electrical connector for connecting a wire harness, or the like. In particular, the present invention is an electrical connector having a compact terminal retaining member for preventing withdrawal of metal terminals inserted in terminal receiving chambers of a connector housing.

2. Description of the Prior Art

Conventional electrical connectors utilize a flexible retaining arm integrally formed with an inner wall of each terminal receiving chamber so as to engage with the metal terminals inserted in the terminal receiving chamber thereby preventing withdrawal of the terminals. Recently, however, another electrical connector design has been proposed wherein a terminal retaining member is attached to a rear portion of the connector housing, so that retainment can be redundantly effected by the combination of the retaining member and the flexible retaining arm, or, in the alternative, solely by the terminal retaining member.

FIG. 9 illustrates a connector of the above-mentioned structure as disclosed in Japanese Laid-Open (Kokai) Patent Application No. 119688/84. Support projections d are formed respectively on opposing walls c of each terminal receiving chamber b of connector housing a. Tapered guide surfaces e are formed behind the support projections d. Also, provisional retaining projections f and primary retaining projections g disposed forward thereof are formed on the outer surfaces of walls c.

Flexible lock arms i and retaining arms k extend forwardly toward connector housing a to which terminal retaining member h is to be connected and are formed integrally on outer and inner surfaces of frame i of terminal retaining member h. Terminal retaining member h is first attached to connector housing a in a provisional condition in which flexible lock arms j are engaged respectively with provisional retaining projections f. In this condition, flexible retaining arms k extend essentially parallel to walls c and therefore do not interact with metal terminal 1 to be inserted into terminal receiving chamber b.

To complete the terminal installation, as shown in FIG. 10, terminal retaining member h is pushed forward, so that flexible lock arms j are engaged respectively with primary retaining projections g. In this position, distal end portions kl of flexible retaining arms k are guided respectively by tapered guide surfaces e, and are thusly bent inward so as to engage and hold wire press-clamping portion m of terminal 1 therebetween. In addition, distal end portions k are disposed rearwardly of support projections n and o of terminal 1 so as to prevent withdrawal of terminal 1.

In conventional electrical connectors, when terminal retaining member h is urged forward relative to housing a from a provisionally connected condition to completely connected condition, frame i projects from the rear of housing a in order to allow for insertion of retaining member h into connector housing a. Accordingly, conventional connectors must be relatively large.

SUMMARY OF THE INVENTION

The present invention has been made in view of the foregoing. Accordingly, an object of the present invention is to provide a compact construction in which the terminal retaining member is entirely accommodated within the length of the connector housing.

In order to achieve the above-mentioned objective, the subject invention utilizes a terminal retaining member which has flexible retaining portions that enter the terminal receiving chambers through side portions thereof. The terminal containing member is adapted to be attached to a rear portion of the connector housing in a two-step manner, that is, in a provisionally connected condition and a completely connected condition. In the provisionally connected condition, the terminal retaining member projects from the connector housing and in the completely connected condition, the terminal retaining member is entirely accommodated within the length of the connector housing.

DETAILED DESCRIPTION OF THE PREFERRED EMBODIMENT

Figure 1:
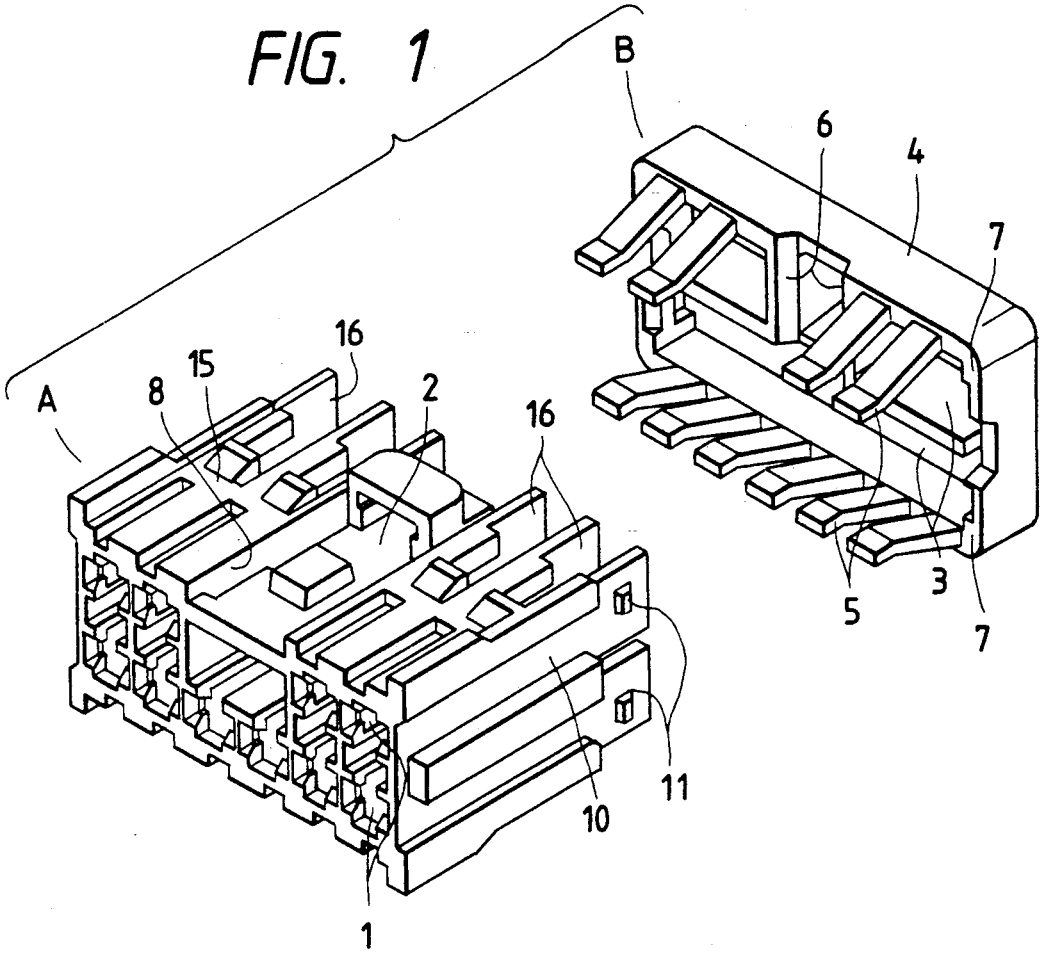
FIG. 1 is an exploded perspective view of a connector housing of the preferred embodiment and a terminal retaining member therefor.
Figure 2:
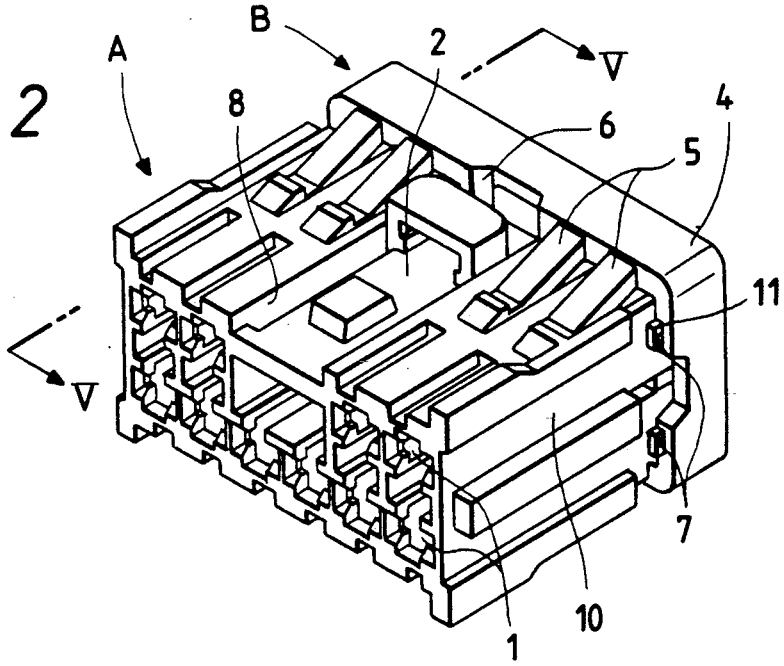
FIG. 2 is a perspective view of the preferred embodiment in a provisionally connected condition.
Figure 3:
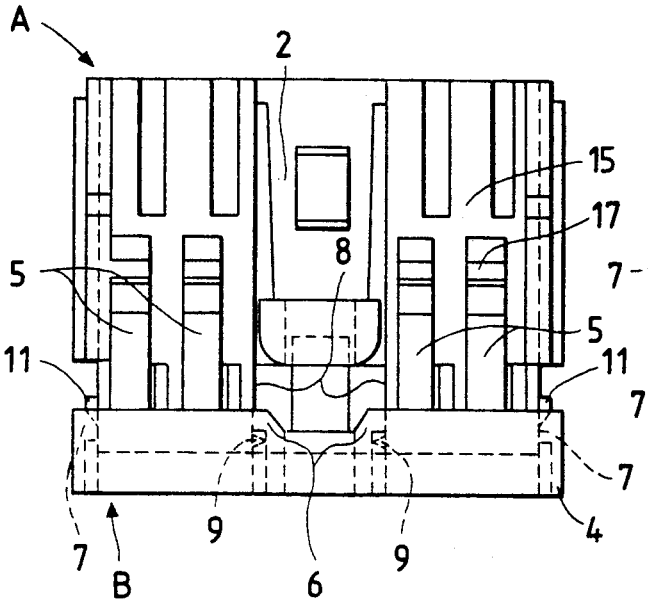
FIG. 3 is a plan view of the preferred embodiment in the provisionally connected condition.
Figure 4:
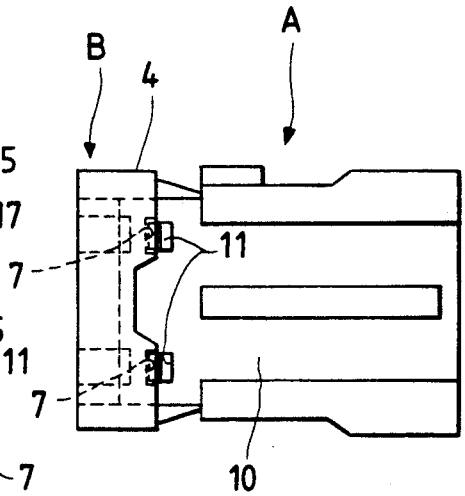
FIG. 4 is a side-elevational view of the preferred embodiment in the provisionally connected condition.

In FIGS. 1–4, reference character A denotes a male connector housing of a synthetic resin or the like, and reference character B denotes a terminal retaining member, of a similar material, to be connected to the rear end of male connector housing A which in turn is adapted to be connected to a mating female connector housing (not shown). Connector housing A has a plurality of juxtaposed terminal receiving chambers 1 arranged therein in two (upper and lower) rows. Also, flexible lock arm 2 for the mating female connector housing is formed on the outer surface of connector housing A.

Terminal retaining member B includes frame-shaped main portion 4 having insertion portions 3 through which metal terminals and wires connected thereto can be passed. Also, a plurality of flexible retaining pieces 5 project from main portion 4 in an inclined direction so as to correspond to the upper and lower rows of terminal receiving chambers 1. Provisional retaining portions 6 are formed on the inner side of main portion 4 at its front portion, and primary retaining portions 7 are formed on an inner surface of main portion 4. At the upper surface of connector housing A, provisional retaining projections 9 (see FIG. 3) are formed on wall surfaces 8 of the recess accommodating flexible lock arm 2, and primary retaining projections are formed on outer side surfaces 10.

Figure 5:
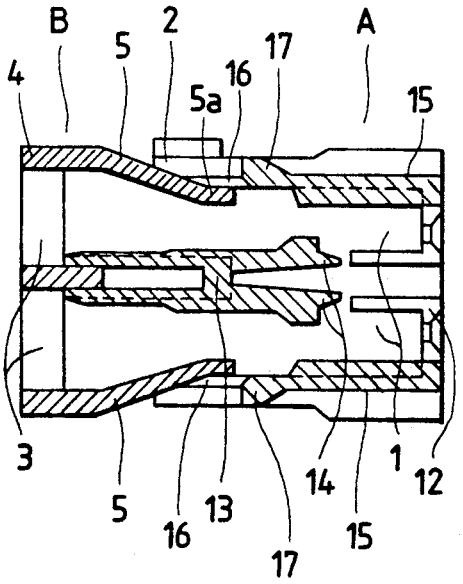
FIG. 5 is a cross-sectional view taken along the line V—V of FIG. 2.

FIG. 5 is a cross-sectional view of the connector before the terminal is inserted. Terminal stopper 12 is provided at the front end of each terminal receiving chamber 1. Flexible retaining arm 14 is formed on an inner wall 13 at an intermediate portion of terminal member B. Open notch 16 is formed in a rear portion of outer wall 15 of each terminal receiving chamber 1, and detection stopper 17, for detecting an incomplete insertion of metal terminal C, is formed at the inner end of open notch 16.

FIGS. 2–5 illustrate the condition of provisional connection between connector housing A and the terminal retaining member B. In this condition, provisional retaining portions 6 are engaged with provisional retaining projections 9, and a rear portion of male connector housing A is received in main portion 4 of terminal retaining portion B. Each inclined flexible retaining piece 5 is extended from the exterior of outer wall 15 into terminal receiving chamber 1 through open notch 16.

Figure 6:
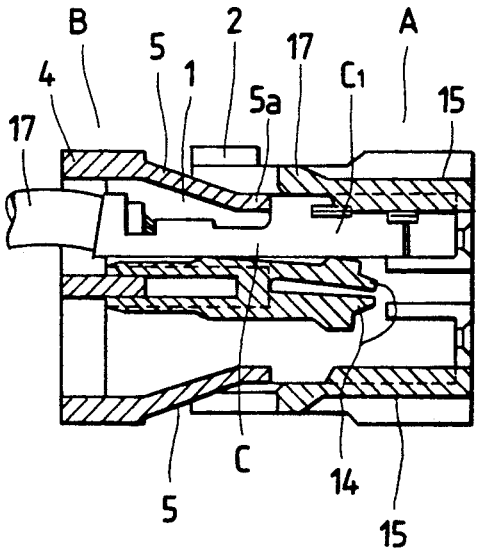
FIG. 6 is a cross-sectional view, of the preferred embodiment, showing the inserted condition of a metal terminal.

While in a provisionally connected condition, terminal C having wire 17 connected thereto is inserted through insertion portion 3 of terminal retaining member B into terminal receiving chamber 1. Female electrical contact portion C1 of metal terminal C flexibly deforms end portion 5*a* of flexible retaining piece 5 as it passes by retaining piece 5. Eventually terminal C completely passes by retaining piece 5 and portion 5*a* elastically returns to its original position (see FIG. 6).

Figure 7:
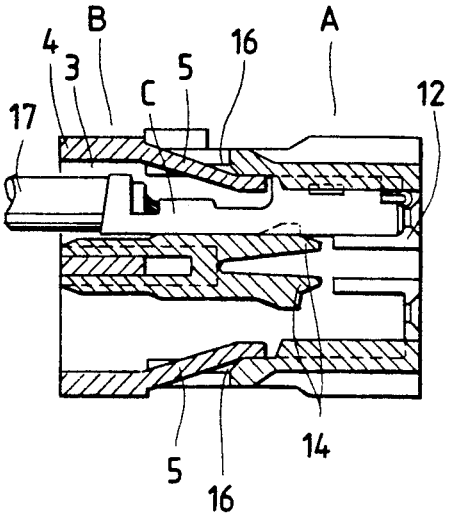
FIG. 7 is a cross-sectional view, of the preferred embodiment, in a completely connected condition.

Upon further insertion of metal terminal C, it is primarily retained by the flexible retaining arm 14. Terminal retaining member B is then pushed from a provisionally connected condition so as to engage primary retaining portions 7 with primary retaining projections 11 to thereby achieve the completely connected condition. Now metal terminal c is secondarily retained by engaging end portion 5*a* of flexible retaining piece 5 (see FIG. 7). If terminal C is not properly inserted and remains at the position shown in FIG. 6, engaging end portion 5*a*, when shifted to a completely connected condition, urges metal terminal C forward and into engagement with flexible retaining arm 14. In a completely connected condition, terminal retaining member B is completely accommodated within the length of connector housing A. In addition, main portion 4 of terminal retaining member B and flexible retaining piece 5 seal notch 16 of connector housing A.

Figure 8:
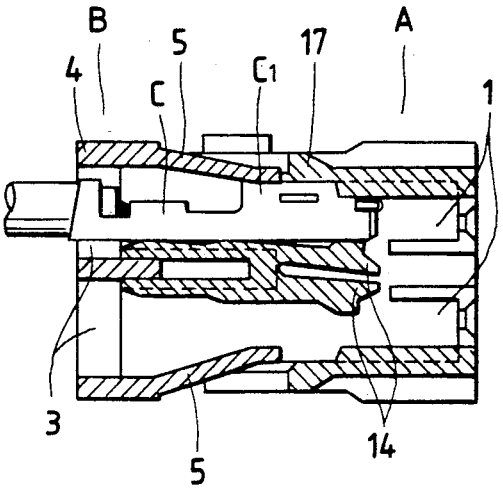
FIG. 8 is a cross-sectional view, of the preferred embodiment, showing an incomplete insertion of the metal terminal in the provisionally connected condition.
Figure 9:
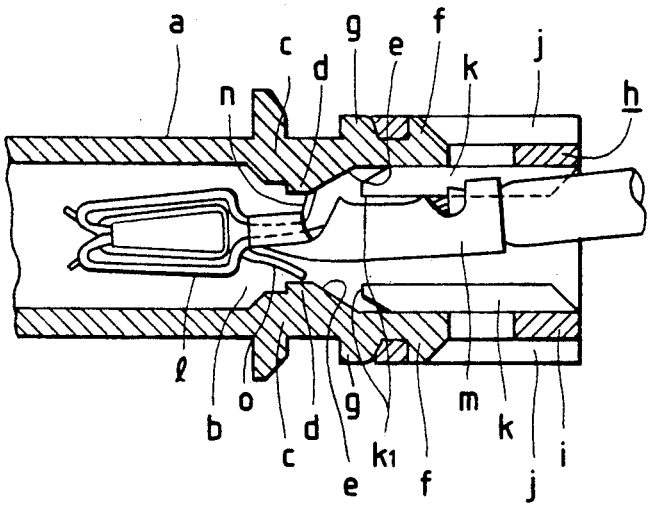
FIG. 9 is a cross-sectional view, of the preferred embodiment, showing a conventional connector housing and a terminal retaining member therefor in a provisionally connected condition.
Figure 10:
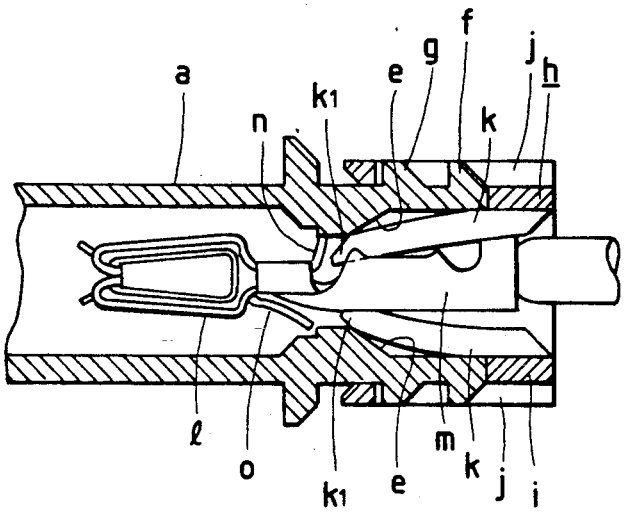
FIG. 10 is a cross-sectional view in a completely connected condition of the prior art.

If for some reason metal terminal C is not inserted past flexible retaining piece 5, end portion 5*a* of the flexible retaining piece 5 is abutted against detection stopper 17, so as to prevent a complete connection until terminal C is more fully inserted into terminal receiving chamber 1 (see FIG. 8).

As described above, the connector of the present invention has a terminal retaining member that is generally accommodated within the range of the length of the connector housing. Therefore, the connector of the present invention can be formed into a compact construction. This is accomplished by allowing retaining pieces 5 to enter terminal receiving chambers 1 through a sidewall thereof. In addition, dust, or the like, is prevented from intruding through the open portion in the outer wall of the connector housing because the terminal retaining member seals off all open portions.

While the present invention has been described with reference to a preferred embodiment, it will be apparent to those skilled in the art that various modifications may be made therein without departing from the scope of the appended claims.

What is claimed is:

1. An electrical connector, comprising:

a housing defining at least one elongated terminal receiving chamber therein extending in a longitudinal direction, said terminal receiving chamber having a terminal receiving hole provided in a rear side of said housing which is perpendicular to said longitudinal direction and being adapted to have a terminal disposed therein extending in said longitudinal direction; and a terminal retaining member having an opening through which said terminal is inserted and having at least one flexible cantilevered member protruding therefrom, said flexible member being adapted for insertion into a respective said terminal receiving chamber through an opening formed on a side of said housing that is parallel to said longitudinal direction so as to engage with, and secure a position of said terminal in said receiving chamber;

wherein said terminal retaining member is disposed on said rear side of said housing and overlaps a portion of said housing so as to be essentially accommodated within the length of said housing when the connector is in a fully assembled condition.

2. A connector as claimed in claim 1, wherein said terminal retaining member essentially encloses said opening when said flexible member is inserted into said opening.

3. A connector as claimed in claim 1, wherein said retaining member is adapted to be secured to said housing in a provisional position in which said terminal may be slidingly inserted into said terminal receiving chamber, a free end of said flexible member being deflected by said housing so as to abut against a portion of said terminal when the connector is in said fully assembled position thereby fixedly securing said terminal in a desired position within said terminal receiving chamber.

4. A connector as claimed in claim 3, wherein said flexible member is deflected by a terminal inserted partially into said terminal receiving chamber so as to cause said flexible member to abut a portion of said housing while in said provisional position thereby preventing the connector from assuming said fully assembled position.

5. An electrical connector, comprising:

a housing defining at least one elongated terminal receiving chamber therein, each said terminal receiving chamber being adapted to have a terminal disposed therein; and a terminal retaining member having at least one flexible member, of a cantilever type, protruding therefrom, said flexible member being adapted for insertion into a respective said terminal receiving chamber so as to operatively engage with, and to secure a position of said terminal in said terminal receiving chamber;

wherein a free end of said flexible member enters said terminal receiving chamber through an elongated opening formed on a side of said housing that is parallel to a longitudinal axis of said terminal receiving chamber, said free end being deflected by said housing so as to operatively engage with a terminal disposed within said terminal receiving chamber thereby securing said terminal therein.

6. A connector as claimed in claim 5, wherein said retaining member is adapted to be secured to said housing in a provisional position in which said terminal may be slidingly inserted into said terminal receiving chamber, a free end of said flexible member being deflected by said housing so as to abut against a portion of said terminal when the connector is in a fully assembled position thereby fixedly securing said terminal in a desired position within said terminal receiving chambers.

7. A connector as claimed in claim 5 wherein said flexible member is deflected by a terminal inserted partially into said terminal receiving chamber so as to cause said flexible member to abut a portion of said housing while in said provisional position thereby preventing the connector from assuming said fully assembled position.

8. A connector as claimed in claim 5, wherein said terminal retaining member essentially encloses said opening when said flexible member is inserted into said opening.

9. An electrical connector, comprising:

a housing defining at least one elongated terminal receiving chamber therein, said terminal receiving chamber being adapted to have a terminal disposed therein; and a terminal retaining member having at least one flexible member protruding therefrom, said flexible member being adapted for insertion into a respective said terminal receiving chamber so as to engage with and secure a position of said terminal in said receiving chamber, wherein said terminal retaining member overlaps a portion of said housing so as to be essentially accommodated within the length of said housing when the connector is in a fully assembled condition, wherein said flexible member is of a cantilever type and enters said terminal receiving chambers through a respective opening formed on a side of said housing that is parallel to a longitudinal axis of said terminal receiving chambers, and wherein said retaining member is adapted to be secured to said housing in a provisional position in which said terminal may be slidingly inserted into said terminal receiving chamber, a free end of said flexible member being deflected by said housing so as to abut against a portion of said terminal when the connector is in said fully assembled position, thereby fixedly securing said terminal in a desired position within said terminal receiving chamber.

* * * * *